United States Patent [19]

Becker et al.

[11] Patent Number: 4,867,067

[45] Date of Patent: Sep. 19, 1989

[54] PROPELLING CAGE SABOT OF COMPOSITE MATERIALS FOR A SUBCALIBER KINETIC ENERGY PROJECTILE HAVING A HIGH LENGTH TO DIAMETER RATIO

[75] Inventors: Wilfried Becker, Düsseldorf; Heinz J. Kruse, Ratingen; Klaus-Dieter Pahnke, Solingen, all of Fed. Rep. of Germany

[73] Assignee: Rheinmetall GmbH, Düsseldorf, Fed. Rep. of Germany

[21] Appl. No.: 81,152

[22] Filed: Aug. 4, 1987

[30] Foreign Application Priority Data

Aug. 4, 1986 [DE] Fed. Rep. of Germany ..... 3625730

[51] Int. Cl.[4] ..... F42B 13/16

[52] U.S. Cl. ..... 102/521

[58] Field of Search ..... 102/520–523, 102/532

[56] References Cited

U.S. PATENT DOCUMENTS

| | | | |
|---|---|---|---|
| 36,773 | 10/1862 | Emery | 102/523 |
| 2,247,563 | 7/1941 | Spalding | 102/523 |
| 3,276,150 | 10/1966 | Hamilton et al. | 102/520 |
| 4,430,942 | 2/1984 | Heyman . | |
| 4,444,114 | 4/1984 | Bisping et al. | 102/523 |

FOREIGN PATENT DOCUMENTS

| | | |
|---|---|---|
| 1808779 | 11/1968 | Fed. Rep. of Germany . |
| 3119646 | 2/1982 | Fed. Rep. of Germany . |
| 3021914 | 9/1983 | Fed. Rep. of Germany . |

*Primary Examiner*—Harold J. Tudor
*Attorney, Agent, or Firm*—Spencer & Frank

[57] ABSTRACT

The invention relates to a propelling cage sabot for a subcaliber, armor piercing kinetic energy projectile having a high length to diameter ratio which will be placed in a tube of a weapon and lauched by propelling charge gases. The sabot has a support member and fixing means. The sabot further having a gas pressure receiving surface to be charged with the propelling charge gases, a longitudinal axis and an air pocket for positively utilizing air flowing in the pocket once the projectile leaves the tube of the weapon. The sabot is segmented for separation from the projectile and includes a joint form-locking zone for attachment with the projectile; and a fiber component connected by the fixing means with the support member for absorbing tensile stresses. The fiber component is made up of more than one oriented individual member. Each individual member is oriented such that the individual member extends along the longitudinal axis between a frontal fixing region and a rear fixing region. The fixing regions, the form-locking zone, the gas pressure receiving surface, and fixing means are all disposed at the support member. Each individual member has a length dimensioned extending between the frontal fixing region and the rear fixing region. The sabot is further configured for converting stresses occurring in the sabot into tensile stresses along at least a portion of the length of each individual member.

29 Claims, 10 Drawing Sheets

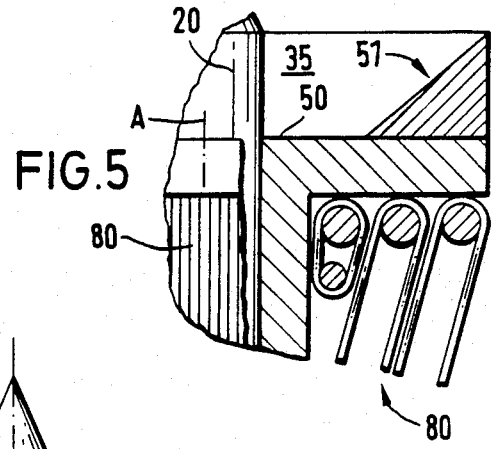
FIG.5
FIG.4
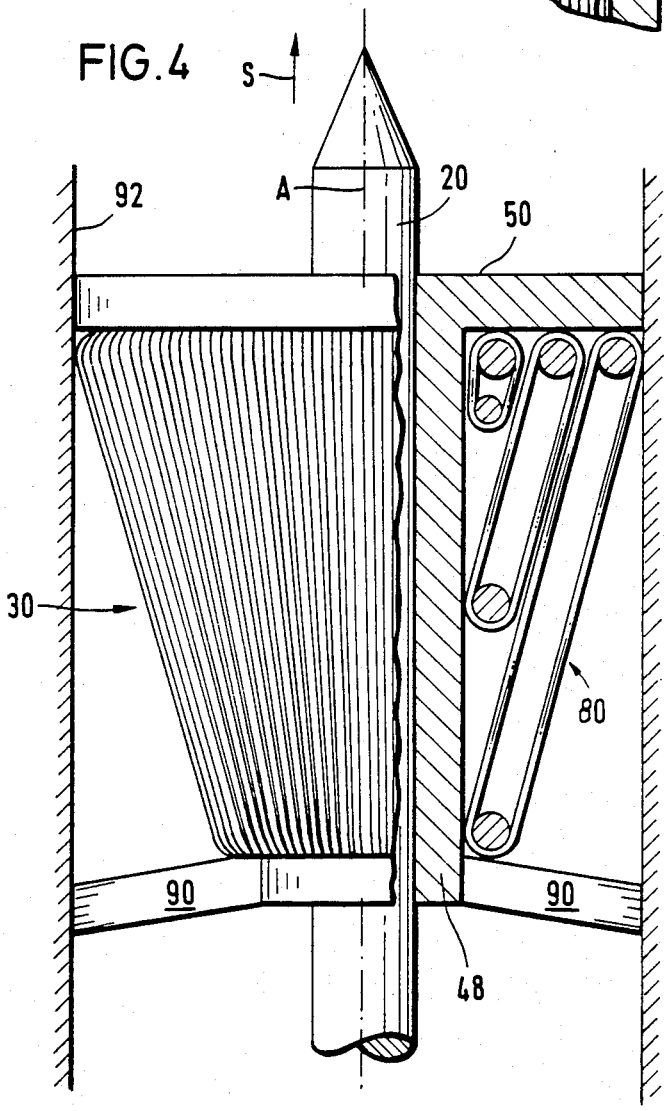

PROPELLING CAGE SABOT OF COMPOSITE MATERIALS FOR A SUBCALIBER KINETIC ENERGY PROJECTILE HAVING A HIGH LENGTH TO DIAMETER RATIO

BACKGROUND OF THE INVENTION

1. Field of the Invention

The present invention is directed to a propelling cage sabot for a subcaliber projectile. The propelling cage sabot includes a fiber component connected with a support member for absorbing tensile stresses.

2. Description of the Prior Art

A compound material including fibers is disclosed in DE-OS 3,119,646. The intention here is to embed staple fibers in a matrix of plastic, for example. Embedding fibers is known in the development of materials and in the shaping of structural components. Reference is made to the stacked arrangement of long, chain-type molecules which when partially curled together form a filament and if oriented substantially parallel, are able to be stretched to a considerable degree when subjected to tensile stresses. Reference is also made to the long proven reinforcement of concrete with steel up to and including prestressed concrete containing a prestressed reinforcement.

The compound material proposed in DE-OS 3,119,646 is based on prior art propelling cage sabot structures. In such structures, the dead load percentage of the propelling cage on the projectile can indeed be reduced considerably while the stresses to be expected permit the use of conventional materials and their inherent strengths.

However, in the course of a desire for continuing increases in performance in armor penetration due to kinetic energy effects, the prior art considerations and their results have been found to be more and more insufficient.

SUMMARY OF THE INVENTION

It is an object of the present invention to provide a propelling cage sabot of the armor penetration type which, by way of measures relating to internal ballistics, produces an increase in the final ballistic performance.

It is a further object of the invention to provide a propelling cage sabot which has a configuration that allows stresses occurring in the sabot to be converted to tensile stresses.

The above and other objects are accomplished by the invention in which a propelling cage sabot for a subcaliber, armor piercing kinetic energy projectile having a high length to diameter ratio will be placed in a tube of a weapon and launched by propelling charge gases. The sabot has a support member and fixing means. The sabot further having a gas pressure receiving surface to be charged with the propelling charge gases, a longitudinal axis and an air pocket for positively utilizing air flowing in the pocket once the projectile leaves the tube of the weapon. The sabot is segmented for separation from the projectile and includes a joint form-locking zone for attachement with the projectile; and a fiber component connected by the fixing means with the support member for absorbing tensile stresses. The fiber component is made up of more than one oriented individual member. Each individual member is oriented such that the individual member extends along the longitudinal axis between a frontal fixing region and a rear fixing region. The fixing regions, the form-locking zone, the gas pressure receiving surface, and fixing means are all disposed at the support member. Each individual member has a length dimension extending between the frontal fixing region and the rear fixing region. The sabot is further configured for converting stresses occurring in the sabot into tensile stresses along at least a portion of the length of each individual member.

BRIEF DESCRIPTION OF THE DRAWINGS

The invention may be better understood by referring to the detailed description of the invention when taken in conjunction with the accompanying drawings in which:

FIG. 4 shows a second embodiment of the propelling cage sabot of FIG. 3 inside the tube of a weapon indicated only schematically.

FIG. 5 is a partial sectional view of one of the two above-mentioned embodiments including a modified front region.

DESCRIPTION OF THE PREFERRED EMBODIMENTS

Figure 1:
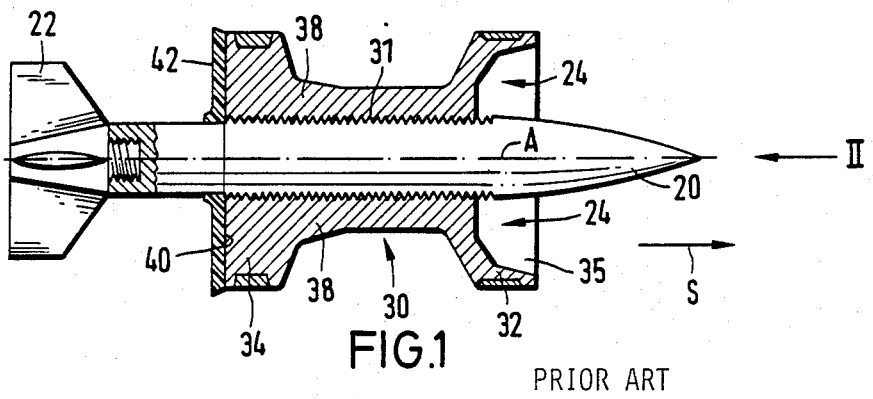
FIG.1 PRIOR ART
FIG. 1 is a primarily longitudinal, axial sectional view of a prior art propelling cage sabot arrangement.
Figure 2:
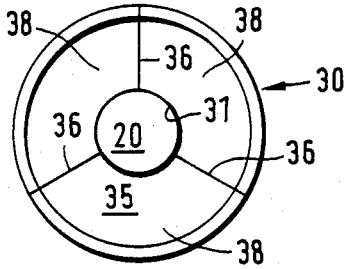
FIG.2 PRIOR ART
FIG. 2 is a view in the direction of arrow II of the arrangement of FIG. 1.

FIGS. 1 and 2 show a prior art arrangement of a subcaliber penetrator 20 having a high length to diameter ratio and including a stabilizing guide assembly 22 and a propelling cage sabot 30. A form-locking zone 31 is associated with the circumference of penetrator 20 and with and adjacent the region of propelling cage sabot 30. A frontal flange 32 has an associated air pocket for air 24 flowing in after the projectile leaves the weapon tube and a rear flange 34 has an associated gas pressure receiving surface 40 which is provided with a sealing element 42. Propelling cage sabot 30 is composed of three segments 38 which are in intimate contact with their respective neighbors along dividing grooves 36. Form-locking zone 31 is provided with corresponding raised portions and recesses, with one example being threads.

Figure 3:
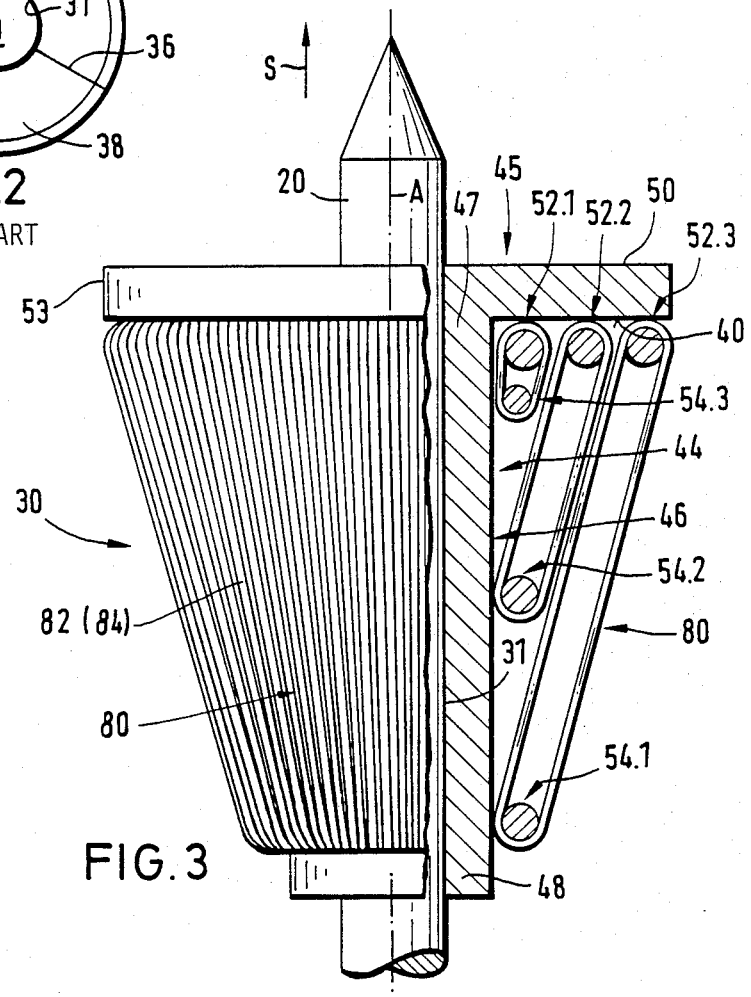
FIG. 3 is a front elevational view and a partially longitudinal axial sectional view of the propelling cage sabot according to the invention.

In the other drawing figures the illustration of a stabilizing guide assembly 22 and details of form-locking zone 31 are omitted for reasons of clarity and to simplify the illustration, for these details reference should be made to FIG. 1. The propelling cage sabot 30 of FIG. 3 is composed of a support member 44 having a flange-shaped front portion 45 on a cylindrical casing 46. Front portion 45 is delimited by a frontal face 50, an adjacent gas pressure receiving surface 40 facing away therefrom and an external circumferential face 53 as well as the front region of form-locking zone 31. Directly associated with front portion 45 are frontal fixing regions 52.1, 52.2 and 52.3. Rear fixing regions 54.3, 54.2 and 54.1 disposed on the exterior of casing 46 correspond with the respective frontal fixing regions. Filament-type individual members 82 (or, if desired, band-shaped individual members 84) of a fibrous component 80 of the compound material extend through fixing regions 52 and 54. The material for fibrous component 80 may be glass, carbon, aramid, etc. In addition to the lowest possible density, it is important that this material has the highest possible tensile strength. Support member 44 may be made of steel, a light metal alloy based on aluminum, titanium or a titanium alloy. In addition to sufficient shape retention, the materal of the support member must also have the lowest possible density. Individual members 82 and 84 extend in several turns and/or layers between and through the respective fixing regions 52 and 54. Front region 47 of the support part 44 designates the attachment region with the front flange 45.

In FIG. 1, a known propelling cage 30 is illustrated, which shows at its stern end a gas-pressure uptake area 40 supplied with a sealing element 42 (for instance, vulcanized rubber). This propelling cage is a push-propelling cage sabot because the center of gravity of the penetrator 20 lies in front of the pressure uptake area or surface 40 whereas the propelling cage sabot according to the present invention is a pull-propelling cage sabot because the center of gravity of the penetrator lies behind the gas-pressure uptake area 40.

The gas-pressure uptake area 40 in the propelling cage sabot according to the present invention is mainly the back surface of the front flagne 45 that is sealed along its external perimeter 53 against the barrel, for instance, with a guide band so that in the outer regions of the propelling cage sabot basically only tensile forces occur.

In the attachment region of the front flange portion 45 on the cylindrical support member 44, strong bending loads can occur. These bending loads can lead to the breaking of the front flange 45 if it were not held by the fiber components 80.

For the bracing of the gas-pressure forces in the known propelling cage sabot (FIG. 1), a relatively large amount of material is necessary in front of the gas-pressure uptake area which means there is a high proportion of dead weight when the total projectile arrangmenet is fired. With the propelling cage sabot according to the present invention the proportion of dead weight is significantly reduced because the material for the fiber components 80 can consist, for example, of aramide fibers, boron fibers, graphite fibers, nylon fibers, silk fibers, mixed-fiber compositions or in a braided or twisted form with a specific weight of about 1.2 g/cm$^3$.

For comparison, it should be mentioned that a fiber with a cross-sectional area of about 1 mm$^2$can resist a tensile loading about 10 times greater than can be greatly thick wire of aluminum alloy with a specific weight of about 3 g/cm. The material of the support member 44 consists of such a firm aluminum alloy and thus it can resist the pressure forces better.

The proportion of aluminum in the propelling cage sabot according to the present invention can thus be reduced significantly if the fiber components 80 are arranged along the external perimeter between the front flange 45 and the back region 48 of the support member 44 in which mainly tensile loadings occur.

The second embodiment according to FIG. 4 can be seen in the tube of a weapon indicated schematically by its interior tube wall face 92 and differs from the first embodiment by radial projections 90 arranged at the rear 48 of propelling cage sabot 30 which serve to support the arrangement in the tube of the weapon. Arrow S is used to designate the direction of flight of the projectile and line A is used to designate the midline of the projectile.

As shown in FIG. 5, the two above-mentioned embodiments may be provided with an air pocket 35 as known from FIG. 1 by placing a circular annular bead 50 having a prismatic cross section on the respective front face 50.

Figure 6A:
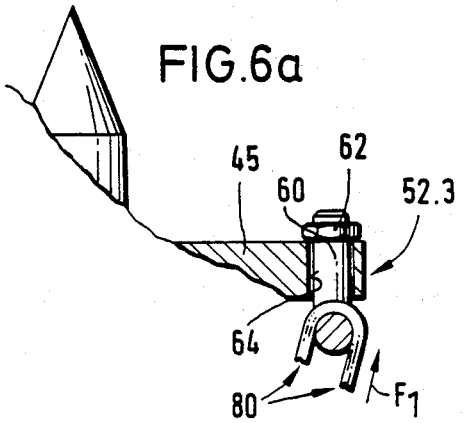
FIGS. 6*a* and 6*b* are partial sectional views of structural details of a frontal fixing region.
Figure 6B:
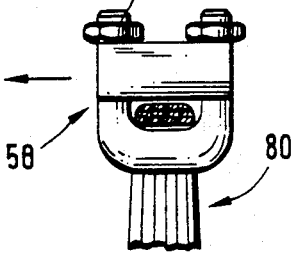

FIG. 6*a* shows a front portion 45 provided with an axially parallel bore 64. The threaded bolt 60 of a shackle 58 shown in FIG. 6*b* engages the shackle 58 through bore 64. In cooperation with tensioning nuts 62, shackle 58 forms a fixing means in frontal fixing region 52.3. If nuts 62 are tightened, the fibers of component 80 are stretched in the direction of arrow $F_1$.

Figure 7A:
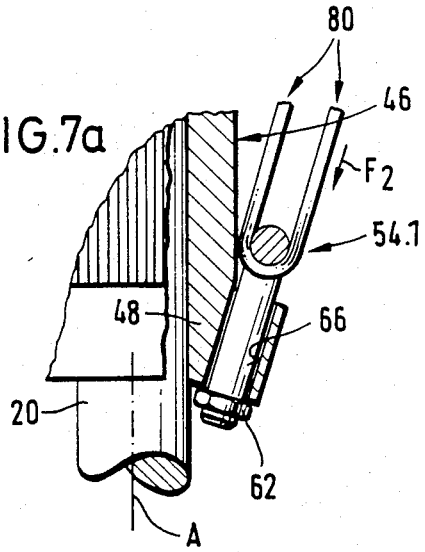
FIGS. 7*a* and 7*b* are partial sectional views of a rear fixing region associated with the above-mentioned frontal fixing region.
Figure 7B:
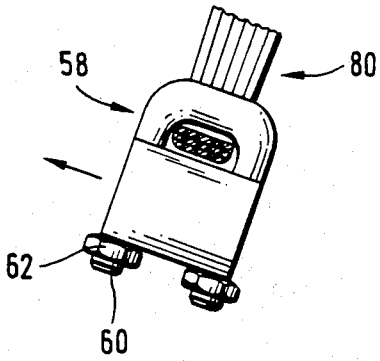

In the rear fixing region 54.1 of FIG. 7*a*, a receptacle 66 for shackle 58 is provided in tail section 48 of casing 46 and is shown in a pivoted position in FIG. 7*b*. Here again, tightening of tensioning nuts 62 provides tension in that fiber component 80 is stretched in the direction of arrow $F_2$.

Figure 8:
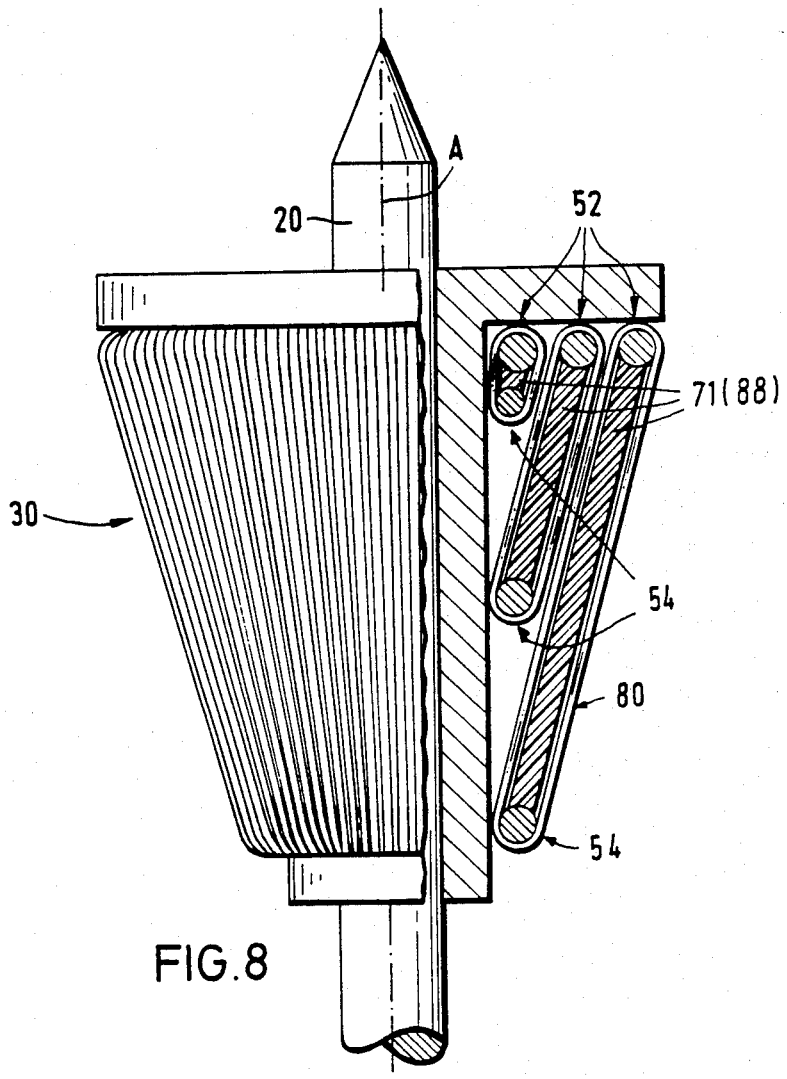
FIG. 8 shows a modified embodiment of FIG. 3 showing another propelling cage sabot.
Figure 9A:
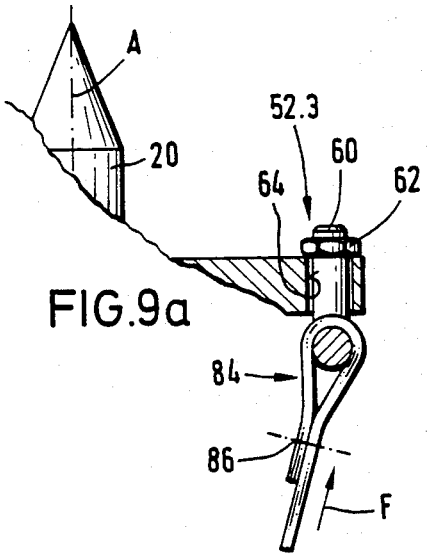
FIGS. 9*a* and 9*b* are partial sectional views of structural details of a frontal fixing region.
Figure 9B:
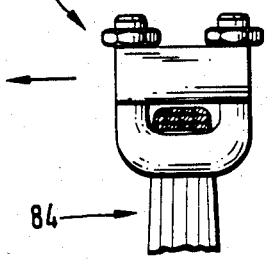
Figure 10A:
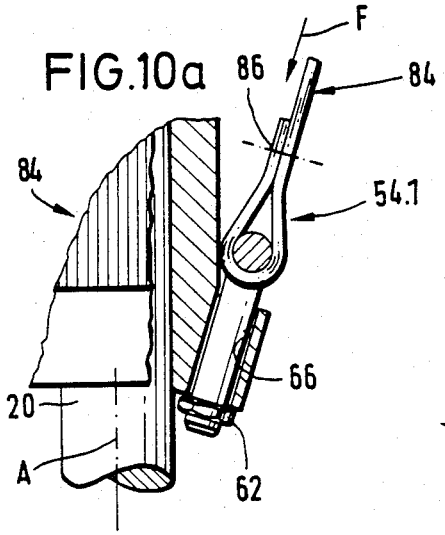
FIGS. 10*a* and 10*b* are partial sectional views of structural details of a rear fixing region associated with the above-mentioned frontal fixing region.
Figure 10B:
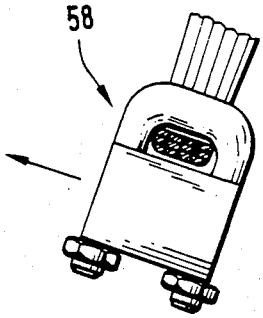

According to FIG. 8, the embodiments of FIGS. 3 and 4 can be modified by stiffening members 71 which may be provided in the form of pressure stressable filler members 88 made of a low density material, for example polyurethane, between mutually associated frontal fixing regions 52 and rear fixing regions 54.

FIGS. 9*a* to 10*b* essentially show details known from FIGS. 6*a* to 7*b*. While, however, in FIGS. 6a to 7*b* the fiber component 80 may be present in filament as well as band form, the embodiments according to FIGS. 9*a* to 10*b* are directed toward band-shaped individual members 84 which have at least one region of attachment, for example a seam or a weld 86. Arrow F shown in FIG. 9*a* and 10*a* (like F'hd 1 and $F_2$ shown in FIG. 6*a* and 7*a*) indicates the direction of tension of the occurring tensile forces.

Figure 11:
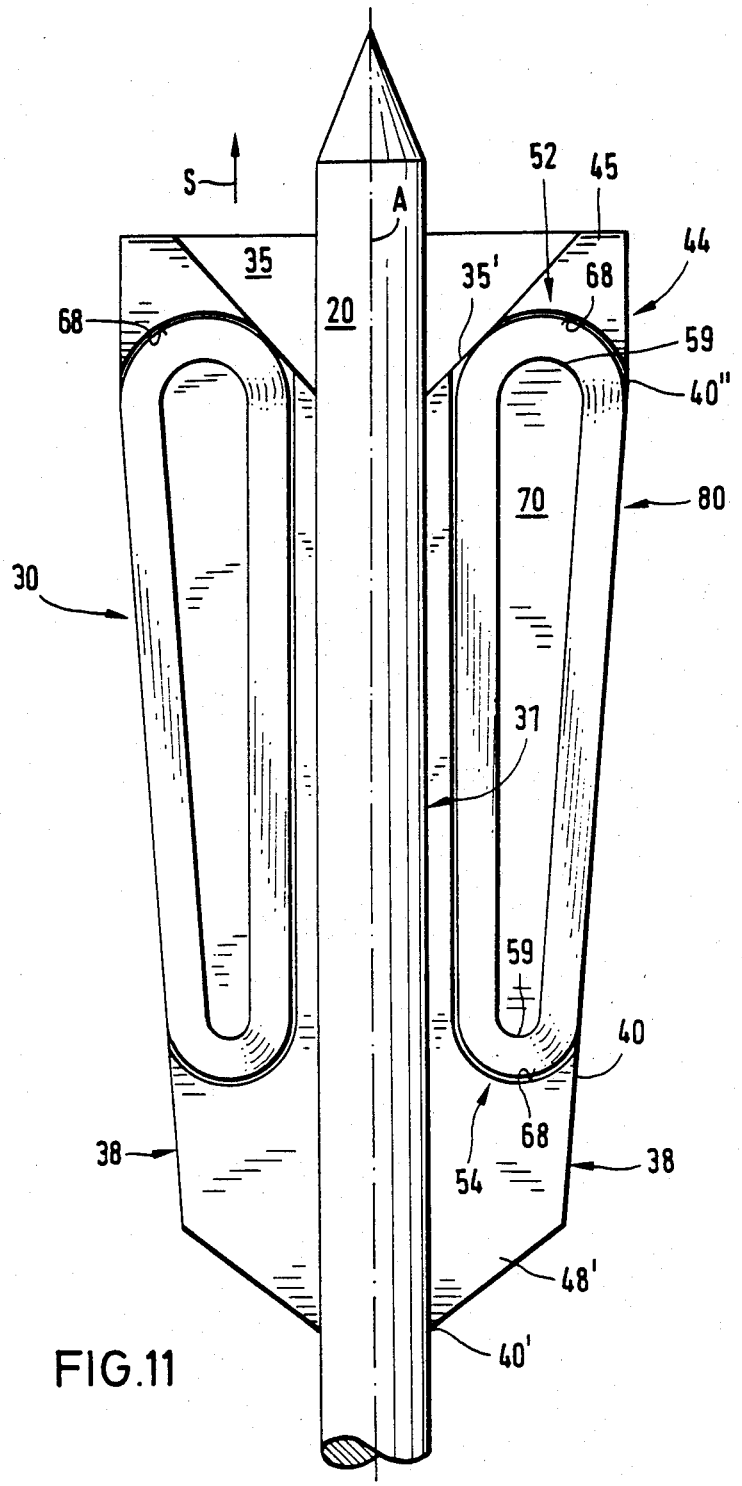
FIG. 11 is a longitudinal axial sectional view of a third embodiment.

In the embodiment according to FIG. 11, support member 44 as a whole has a large wall thickness and a conical circumference so that the gas pressure receiving surface 40 extends from a rear edge 40' to a front edge 40" in the vicinity of frontal fixing region 52. "Endless" recesses 68 distributed regularly over the circumference are provided with a web 70 in their center regions in which fixing means 59 are held in fixing regions 52 and 54. The fiber component 80 here may be composed of filamentary individual members 82 as well as band-shaped individual members 84. By providing a frontal funnel face 35', an air pocket 35 is created. A closed form-locking zone 31 extends in the region in question over the circumference of the penetrator. Stern or tail part 48' like 48 (in FIG. 7a) is located at the rear of the sabot.

The exact cross-sectional form of the fiber components 80 may take many forms. The preferred cross section for filammentary individual members 82 is round or square (being sized for example from 0.5 to 1 $mm^2$). The preferred cross section for band-shaped individual members 84 is a flattened rectangular cross section (being sized for example from 1.0 to 1.5 $mm^2$). In FIGS. 6b, 7b, 9b and 10b, a set of bands is illustrated (in this case about 12 individual bands with a total cross-sectional area for example of 12 $mm^2$). These bands are in groups of four next to each other and in three layers on top of each other with the entire set being through the shackle 58.

Figure 13:
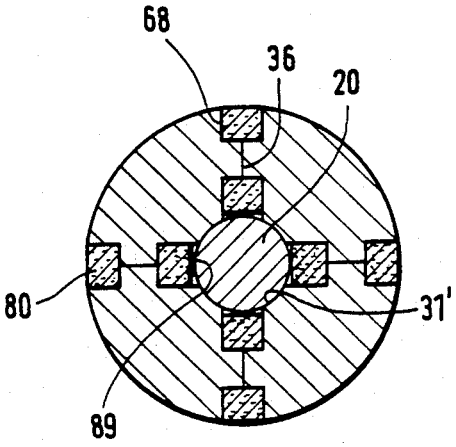
FIG. 13 is a sectional view along line XIII—XIII of the fourth embodiment.
Figure 12:
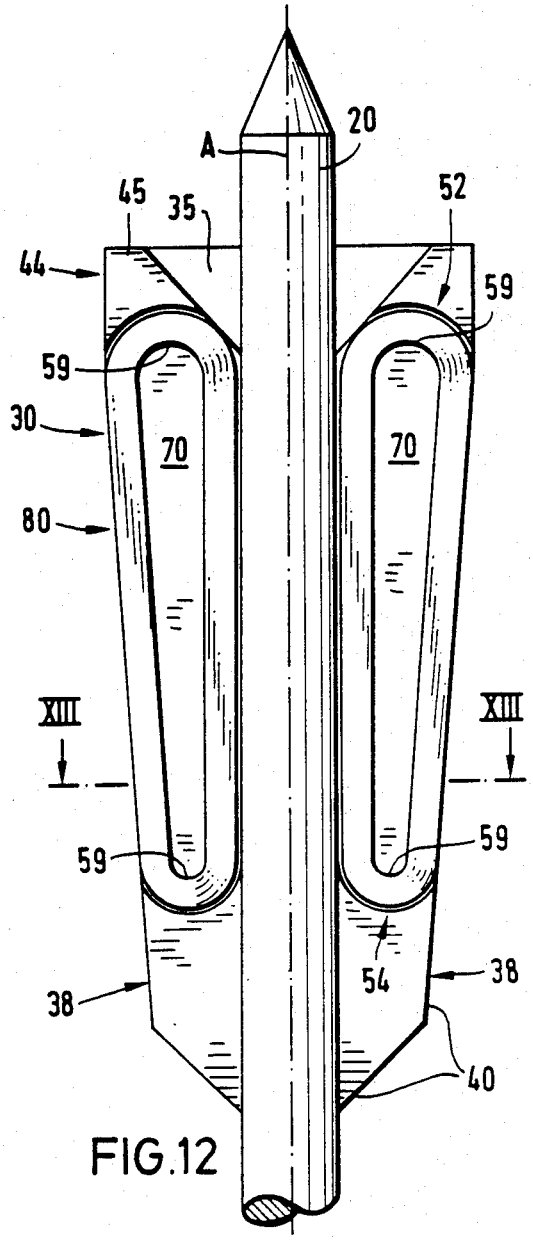
FIG. 12 is a longitudinal axial sectional view of a fourth embodiment.

The embodiment according to FIGS. 12 and 13 is modified compared to that of FIG. 11 and that form-locking regions 31' alternate with regions 89 in which fiber component 80 contacts the circumference of penetrator 20.

Compared to the prior art arrangement shown in FIGS. 1 and 2, all embodiemtns of the invention reveal very significant possibilities for reducing the dead load components of propelling cage sabot 30 on projectile arrangement 20. In each case, fiber component 80 forms elements comparable to high tensile strength tie rods which, with the lowest possible average density of the arrangement, permit the highest possible stressability of the material of support member 44 in that any shearing stresses occurring therein are substantially converted to tensile stresses in the direction of fiber component 80.

Figure 14:
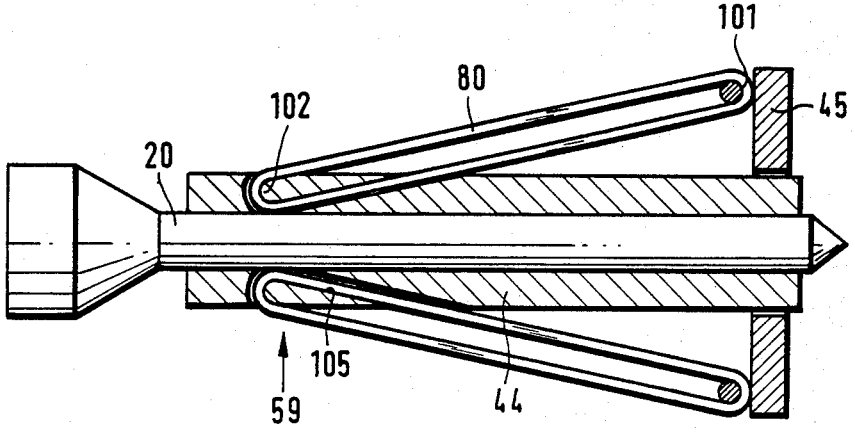
FIGS. 14–20 are cross-sectional views showing further advantageous possibilities of the propelling cage sabot according to the invention.

The embodiment according to FIG. 14 shows a double guided course of the fiber components 80, and specifically show a front point of reversal 101 on the front flange portion 45 and a back point of reversal 102 in the rear portion of the support member 44.

The ends of the fiber components can be attached to each other at any desired point. This can be achieved, for example, by knotting, gluing or heat-sealing.

The rear fixation means 59 are developed in the form of gaps 105 for the reception and passage of the fiber components 80 integrated in the support member 44.

Figure 15:
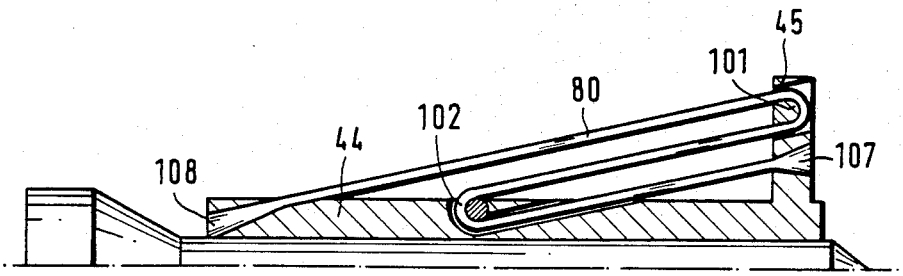

In FIG. 15, the course of the fiber components 80, in this case a triple parallel course, is illustrated. Between the points of attachment of the fiber ends two points of reversal 101, 102 of the fiber components are planned.

In this embodiment the fiber components are not developed as a surrounding double band but they are attached with one end firmly on the front flange portion 45 and with the other firmly on the rear portion of the support 44. For the purpose of attachment, the ends of the fiber components 80 on the front flange portion 45 and on the rear portion of the support member 44 are gaps that widen in a cone-like fashion toward the front and back, respectively. The ends of the fiber components 80 spread out after being poured and glued, respectively, or heat-sealed.

Figure 16:
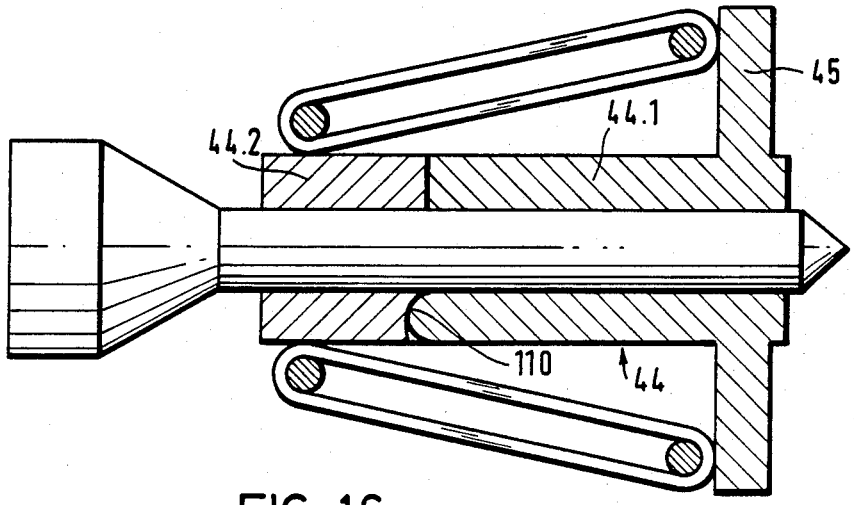

In a further embodiment according to FIG. 16, the support member 44 is divided not only for segmentation of the propelling cage sabot in longitudinal direction but also, in a plane vertical to the longitudinal axis of the projectile. This means there is a front and a back piece of the support member part 44.1 and 44.2 to achieve a better and faster separation of the segments of the propelling cage sabot from the body of the projectile. In an improved version of this embodiment the front and back pieces of the support part 44.1 and 442. are movably joined to each other by at least one hinge-like connection 110 that can be folded out.

Figure 17:
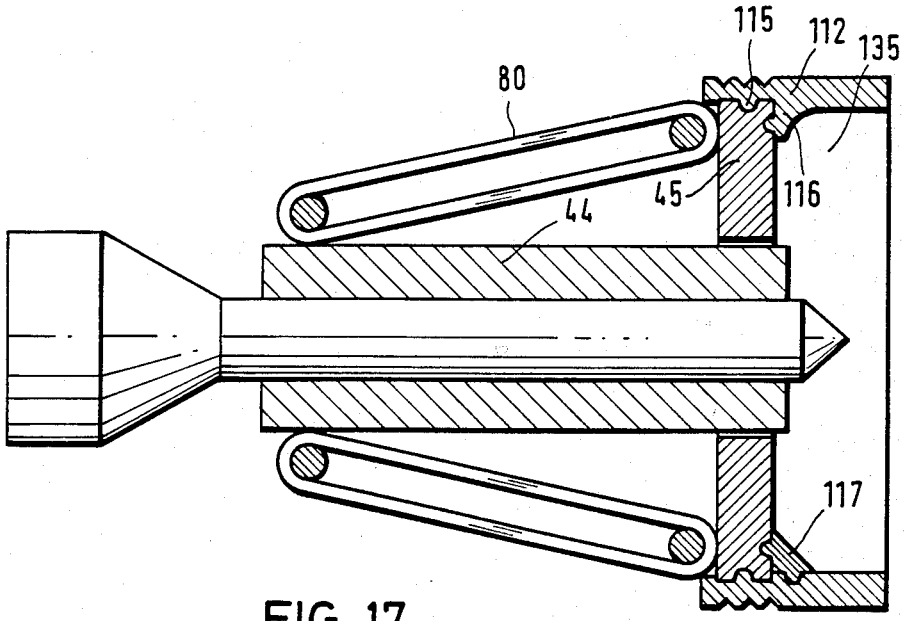

In another embodiment according to FIG. 17, a propelling cage sabot has attached to the front flange 45 a broad guide band 112 along its external perimeter. The guide band is extends forwardly for the formation of an air pocket 135. The guide band 112 can be attached by means of an annular groove 115 on the front flange portion 45 and brace itself by means of a strut 116 against the front surface of the front flange. For bracing, however, a separate ring-like strengthening member 117, for example, made of PVC material, can also be utilized.

Figure 18:
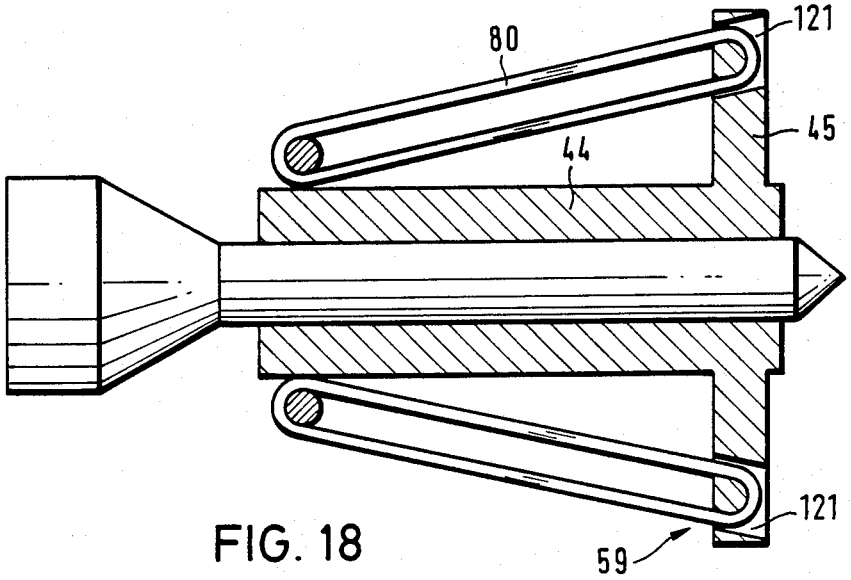

In FIG. 18, a modified embodiment is illustrated according to which the anterior fixation means 59 are integrated into the front flange 45 and the fixation means are gaps 121 for the reception and passage of the fiber components.

Figure 19:
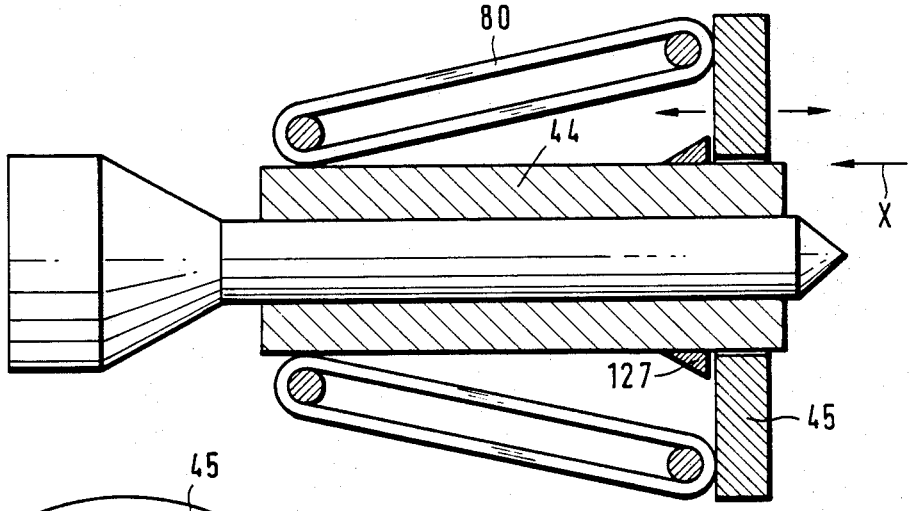
Figure 20:
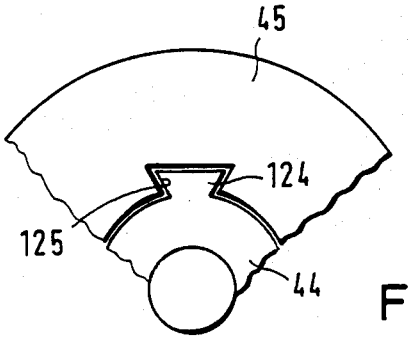

A final embodiment is illustrated in FIG. 19 and a partial frontal view of FIG. 19 according to arrow X is shown in FIG. 20. According to a special feature of this embodiment, the propelling cage sabot has a front flange portion 45 that is axially movably arranged on the support member 44. To avoid sideways twisting of the front flange portion 45 on the support member 44, the support member 44 has a swallow-tail connector bar 124 for each segment and the front flange portion 45 has a correspondingly developed notch 125, which facilitates an axial shift (FIG. 20).

By this embodiment, the fiber component 80 is tensed according to the occurring gas pressure. To limit an excessive shift of the front flange portion 45 an abutment 127 on the support part 44 is planned behind the front flange portion.

The attachment of the individual members to each other is achieved in the customary fashion with the aid of guide bands, sealing bands, or holding bands. A sealing or holding band encircles the propelling cage on the outer circumferential surface of the front flange portion and one or two additional holding bands encircle the propelling cage sabot in the middle and rear portions, respectively. The holding bands are blown open after firing and leaving the orifice of the barrel by the dynamic pressure of the air so that the segments of the propelling cage can be separated from the body of the projectile without interference.

The fixation means for the fiber components illustrated in FIGS. 6a, b; 7a, b; 9a, b; 10a, b are shown as individual shackles or clevises 58. However, the fixation means can be developed as a circumferential ring-like rod (divided along the separation gaps of the propelling cage sabot), which is attached by means of a few stable connector rods on the front flange portion and support member, respectively. The connector rods for the stable support of the ring-like rod are configured to be elongated in a radial direction, but very narrow in the circumferential direction. The fiber components run in the front attachment region arranged next to each other around such a ring-like rod; in the rear attachment region with the smaller circumference, the fiber components may be led in groups of two or three on top of each other around one such ring-like rod. Thus a closed outer surface of the propelling cage sabot as illustrated, for example, in FIG. 3 can result.

Of course, the features shown in the figures can be combined or exchanged with each other as desired.

The present invention may employ both individual members 82 and 84 simultaneously next to each other in a modified embodiment of the invention. In a further embodiment, the form of the cross-section of the individual members can change continuously from front to back with the crosssectional area (for example, 1 $mm^2$) and the tensile strength remaining constant. Thus, while the overall fiber component 80 was attached to the front attachment region 52, the fiber component 80 would have a large circumference and the individual members would have a rectangular cross-section (similar to band-shaped individual member 84). Where the overall fiber component 80 was attached to the rear attachment region 54 the fiber component 80 would have a small circumference and the individual members would have a round or square cross-section (similar to filamentary individual members 82).

It will be understood that the above description of the present invention is susceptible to various modifications, changes and adaptations, and the same are intended to be comprehended within the meansing and range of equivalents of the appended claims.

What is claimed is:

1. A propelling cage sabot for a subcaliber, armor piercing kinetic energy projectile having a high length to diameter ratio which will be placed in a tube of a weapon and launched by propelling charge gases;

said sabot having a support member and fixing means; said sabot further having a gas pressure receiving surface to be charged with the propelling charge gases, and a longitudinal axis; said sabot being longitudinally segmented for separation from the projectile and including a joint formlocking zone for attachment with the projectile; and a plurality of individual members uniformly distributed about the periphery of said sabot and connected by said fixing means with said support member for absorbing tensile stresses; and wherein:

(a) said individual members are each formed of a plurality of lengths in the shape of one of an individual filament and a band of individual filaments of a fiber material having a high tensile strength and a low density relative to that of said support member;

(b) each said individual member is oriented such that said individual member extends along said longitudinal axis between a front fixing region and a rear fixing region which regions contain the respective said fixing means;

(c) said fixing regions, said form-locking zone, said gas pressure receiving surface, and said fixing means are all disposed on said support member;

(d) each said individual member has a length dimension extending between said frontal fixing region and said rear fixing region; and (e) said front fixing region, said rear fixing region and said individual members are disposed on said sabot for converting bending stresses occurring in said support member into tensile stresses along at least a portion of the length dimension of each individual member.

2. A propelling cage sabot as defined in claim 1, wherein said individual members have a filament shape and extend without interruption in at least one layer through said fixing regions.

3. A propelling cage sabot as defined in claim 1, wherein said individual members have a band shape and extend without interruption in at least one layer through said fixing regions.

4. A propelling cage sabot as defined in claim 2, wherein said individual members and said fixing means are pre-tensioned.

5. A propelling cage sabot as defined in claim 3, wherein said individual members and said fixing means are pre-tensioned.

6. A propelling cage sabot as defined in claim 1, wherein said gas pressure receiving surface extends at least into part of an immediate vicinity of said front fixing region.

7. A propelling cage sabot as defined in claim 1 wherein said sabot further includes an air pocket, disposed at the front of said sabot, for positively utilizing air flowing into said pocket once a projectile to which the sabot is attached leaves the tube of a weapon to separate the sabot from the projectile.

8. A propelling cage sabot as defined in claim 7, said support member further comprising a recess and a front portion, wherein said air pocket is formed by said recess in said front portion of said support member.

9. A propelling cage sabot as defined in claim 7, said sabot further comprising a front face and a circular annular bead, wherein said air pocket is formed by said front face and said circular annular bead.

10. A propelling cage sabot as defined in claim 9, wherein said circular annular bead has a prismatic cross section.

11. A propelling cage sabot as defined in claim 9, wherein said circular annular bead is made of a low density material.

12. A propelling cage sabot as defined in claim 1, wherein said support member, at least in said fixing regions and said form-locking zone is composed of a material with a low density which ensures high shape retention of said support member.

13. A propelling cage sabot as defined in claim 1, wherein said sabot further includes stiffening means, and wherein said stiffening means extends between associated ones of said frontal and rear fixing regions.

14. A propelling cage sabot as defined in claim 13, wherein said stiffening means is composed of low density filler members.

15. A propelling cage sabot as defined in claim 1, wherein each said individual member has said length dimension which extends at least between said frontal fixing region and said rear fixing region and back to said frontal fixing region.

16. A propelling cage sabot as defined in claim 1, wherein each said individual member has said length dimension which extends between said frontal fixing region and said rear fixing region at least three times, whereby there is at least two points of reversal for said individual member, one being located at said frontal fixing region and another being located at said rear fixing region.

17. A propelling cage sabot as defined in claim 1, wherein said rear fixing region includes spaces for accommodating each said individual member.

18. A propelling cage sabot as defined in claim 1, wherein said frontal fixing region includes spaces for accommodating each said individual member.

19. A propelling cage sabot as defined in claim 1, wherein each said individual member has a first end and a second end, said first end and said second end of each said individual member being attached to one another.

20. A propelling cage sabot as defined in claim 1, wherein said support member is separated transverse to said longitudinal axis of said sabot into front and back support pieces.

21. A propelling cage sabot as defined in claim 20, wherein said sabot further comprises at least one hinge-like junction, said front and back support pieces being connected by said at lesat one hinge-like junction.

22. A propelling cage sabot as defined in claim 1, wherein each said individual member has a first end and a second end, wherein said first end is attached to said frontal fixing region and said second end is attached to said rear fixing region.

23. A propelling cage sabot as defined in claim 22, wherein said frontal fixing region and said rear fixing region include conically shaped spaces to accommodate said first and second ends of each said individual member.

24. A propelling cage sabot as defined in claim 1, wherein said frontal fixing region is axially movable on said support member.

25. A propelling cage sabot as defined in claim 1, said sabot further comprises a broad guide band and said frontal fixing region includes an external perimeter, wherein said broad guide band is disposed along said external perimeter, whereby said broad guide band partially defines an air pocket in front of said sabot.

26. In a discardable propelling cage sabot for a sub-caliber, armor piercing kinetic energy projectile having a high length to diameter ratio which will be placed in a tube of a weapon and launched by propelling charge gases, said sabot including a body, formed of a plurality of longitudinal segments, which surrounds a projectile along a portion of its length, which has a gas pressure receiving surface to be charged with propelling charge gases, and which has a form-locking zone for attachment of the sabot to the projectile; the improvement wherein: said body comprises an elongated cylindrical member having a radially extending flange at its front end, with a rear surface of said flange constituting said gas pressure receiving surface; and tensioned means for counteracting bending stresses in said flange during launching of a projectile, said tensioned means including a plurality of individual members, each formed of one of a plurality of lengths of individual filaments and a plurality of lengths of bands of a plurality of filaments of a fiber material having a high tensile strength and a low density relative to that of said sabot body, said individual members being uniformly distributed about the periphery of said body, with each said individual member having a length which extends obliquely to the longitudinal axis of said cylindrical member and having a first end and a second end adjacent said flange and the outer surface of said cylindrical member, respectively, and means for attaching said first and second ends of said individual members to said flange and to said cylindrical member, respectively such that each said individual member passes through the associated said means for attaching at least at one of its two ends without interruption so as to reverse its direction.

27. A sabot as defined in claim 26 wherein said individual members formed of a fiber material are uniformly distributed around the periphery of said body in a plurality of layers.

28. A sabot as defined in claim 26 further comprising means for radially supporting and centering the rear of said sabot within the tube of a weapon, said means for radially supporting including a plurality of projections extending radially from the outer surface of said cylindrical member adjacent its rear end.

29. A sabot as defined in claim 26 wherein each said individual member comprises a continuous loop of one of an individual filament and a band of a plurality of individual filaments of said fiber material.

* * * * *